US005896590A

United States Patent [19]

Fleisch

[11] Patent Number: 5,896,590

[45] Date of Patent: Apr. 27, 1999

[54] PROTECTION DEVICE FOR HEAD AND BODY OF PEOPLE

[75] Inventor: Eugen Fleisch, Rottenburg, Germany

[73] Assignee: Ise Innomotive Systems Europe GmbH, Bergneustadt, Germany

[21] Appl. No.: 09/025,459

[22] Filed: Feb. 18, 1998

Related U.S. Application Data

[63] Continuation of application No. PCT/DE97/01235, Jun. 18, 1997.

[30] Foreign Application Priority Data

Jun. 19, 1996 [DE] Germany ..... 196 24 556

[51] Int. Cl.[6] ..... A42B 3/32

[52] U.S. Cl. ..... 2/455; 2/468; 2/410; 2/425; 224/576; 224/186

[58] Field of Search ..... 2/410, 411, 413, 2/414, 425, 455, 456, 468, 202, 205, 171.03, 209.11, 422; 224/190, 186, 187, 188, 189, 576; 135/132, 133, 139, 90, 96

[56] References Cited

U.S. PATENT DOCUMENTS

| | | | |
|---|---|---|---|
| 1,803,538 | 5/1931 | Pistole | 224/187 |
| 3,708,803 | 1/1973 | Teaff . | |
| 4,112,957 | 9/1978 | Biven | 2/410 |
| 4,179,053 | 12/1979 | Figura | 224/190 |
| 4,291,417 | 9/1981 | Pagano . | |
| 4,685,151 | 8/1987 | Kincheloe . | |
| 5,116,288 | 5/1992 | Kondo et al. | 2/209.11 |

FOREIGN PATENT DOCUMENTS

| | | | |
|---|---|---|---|
| 62052 | 3/1944 | Denmark | 2/410 |
| 0 150 876 A2 | 8/1985 | European Pat. Off. . | |
| 398134 | 5/1909 | France | 2/202 |
| 268182 | 8/1912 | Germany . | |
| 27 17 234 A1 | 11/1978 | Germany . | |
| 28 25 145 A1 | 12/1979 | Germany . | |
| 3811057 | 12/1989 | Germany | 2/456 |
| 90 16 306 U | 4/1991 | Germany . | |
| 43 33 141 C1 | 4/1994 | Germany . | |

*Primary Examiner*—Michael A. Neas
*Attorney, Agent, or Firm*—Panitch Schwarze Jacobs & Nadel, P.C.

[57] ABSTRACT

An automatic safety helmet and cover protection can be worn on the back, mainly of people who play sport. The protection device is stored in a rucksack casing (3) and is attached to back straps (4–6). The casing accommodates essentially a guard (11–19), a drive member and a control mechanism. There is storage space in the center for various implements. By triggering a spring accumulator (40.1, 40.2), the protection device is rotated, in the event of a threatening fall, into an erect protective position in fractions of a second by way of a trigger cord or by automatic actuation due to a sensor (23). The protective position is held at the top by a toothed catch member (7.1, 7.2). Mating toothing on the catch member maintains the protective position even in the event of a change in direction.

9 Claims, 8 Drawing Sheets

PROTECTION DEVICE FOR HEAD AND BODY OF PEOPLE

CROSS-REFERENCE TO RELATED APPLICATION

This application is a continuation of International Application PCT/DE97/01235, filed Jun. 18, 1997.

BACKGROUND OF THE INVENTION

The invention involves an automatic protection helmet, as protection against a tumbling fall for persons, wherein the protection helmet can be adjusted into a protective position from a set resting position worn in a casing on the back or chest of the person. The helmet is equipped with a drive element integrated into the casing, with the force of the drive element serving to rotate the helmet toward the top (head of the person).

A protection device of this type is already known from DE 2825145 A1, for example. The known protection device is fixed above the head, so that it is not very pleasant to wear during physical exercise.

SUMMARY OF THE INVENTION

The object of the invention is thus to further develop a passive protection device of the generic type, so that it is technically equipped in such a way that the protection is optimally improved without active involvement. In this way, not only head injuries, but also fractures of the cervical vertebra, collar-bone injuries, and back injuries are prevented.

The protection device is positioned in a casing which is similar to a backpack and shaped to fit the contours of the body. It is affixed to the back with belts for the shoulders, hips and pants. The forces acting during a fall are thus transmitted to the body to a great extent. During a hazardous fall, the protection device can be rotated into an upright protective position via the release of a spring in fractions of a second by a release line or by automatic control through a sensory mechanism.

The extended U-shaped protective bars (p-bars) have impact-absorbing properties and are provided with integral foam, as well as with a highly-resilient foam layer, against the head and body side. These properties correspond to the state of the art in their light manner of construction, and they are applied in crash helmets, for example. Furthermore, the inflation of the p-bars would also be a technically known possibility (comparable to an airbag).

The object of the invention is achieved by a protection device of the type mentioned at the outset having a support element with two round toothed disks which are set into rotating motion by the force of pre-loaded springs, whereby the p-bars are brought into their protective position. Advantageous embodiments of the invention can be gathered from the detailed description and the remaining claims.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
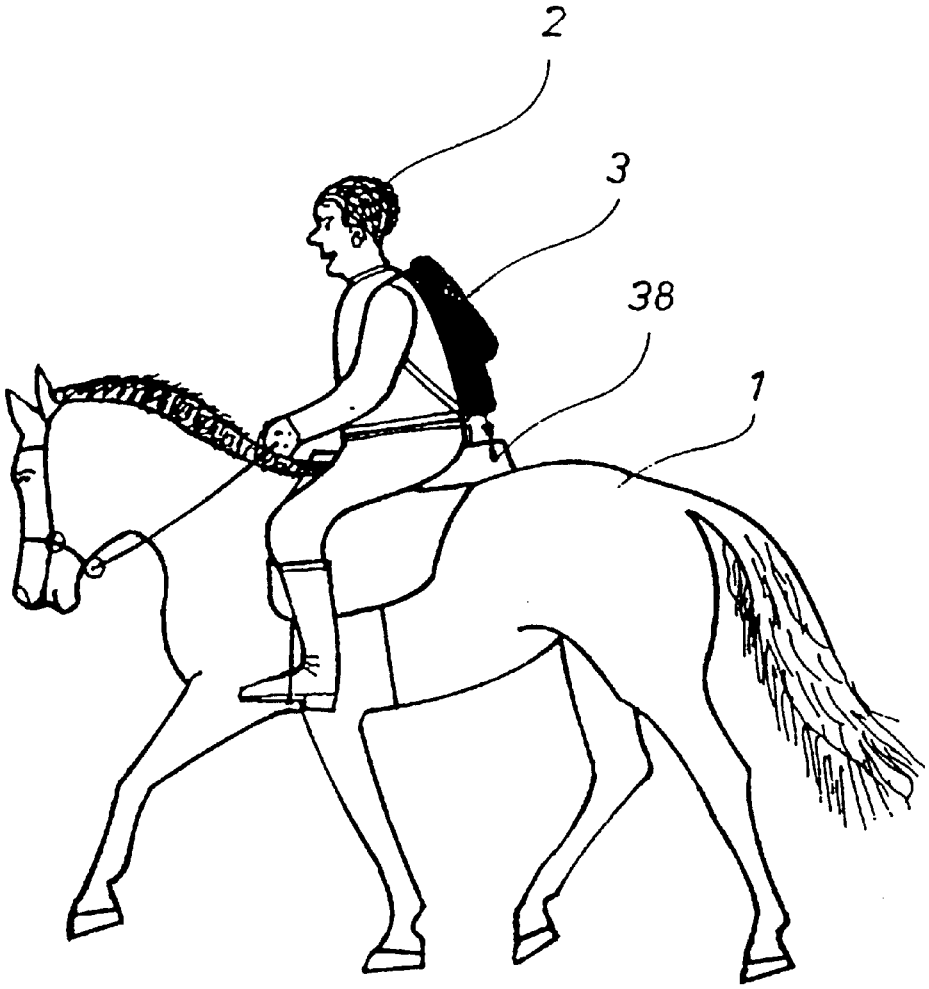
FIG. 1 is a side view of a horse 1 with rider 2, who wears a backpack (casing) with a folded protection device on his back.
Figure 2:
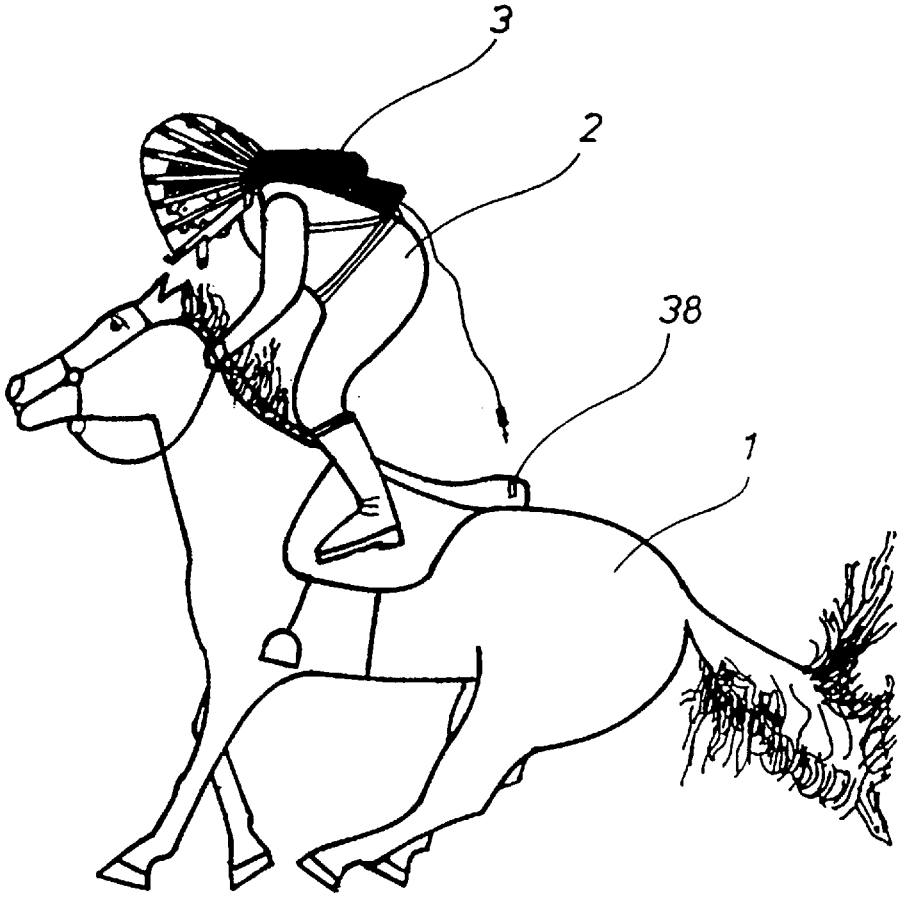
FIG. 2 is a side view of a horse 1 which is throwing off the rider 2 and thus shows the function of the triggered automatic protection device (protection helmet)
Figure 3:
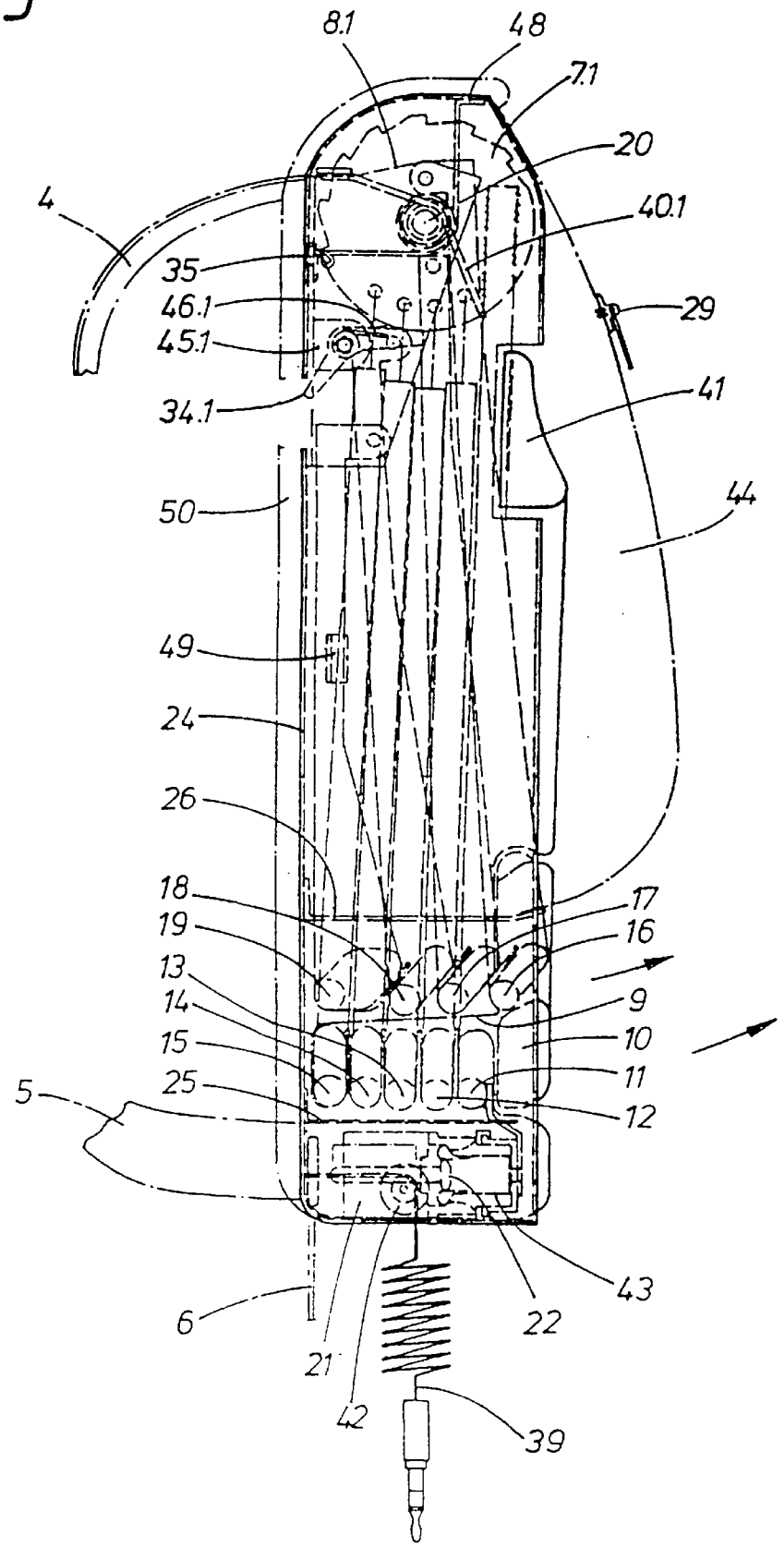
FIG. 3 is a side view of a safety caging 3 showing the folded-together, spring-loaded protection device with release and drive sections.

FIG. 1 shows a horse 1 with rider 2, who is wearing a safety casing 3 similar to a backpack. This safety casing 3 is fixed firmly to the body with the belts 4, 5, 6.

These p-bars 12, 13, 14, 15, 16, 17, 18, 19 altogether fashioned in a U-shape are mounted pivotably with the front end regions in the reinforcement pieces 8.1, 8.2 and the toothed disks 7.1, 7.2 on a guide rod 20 fixed in the casing. The p-bar 11 is firmly connected with the toothed disks 7.1, 7.2.

Figure 5:
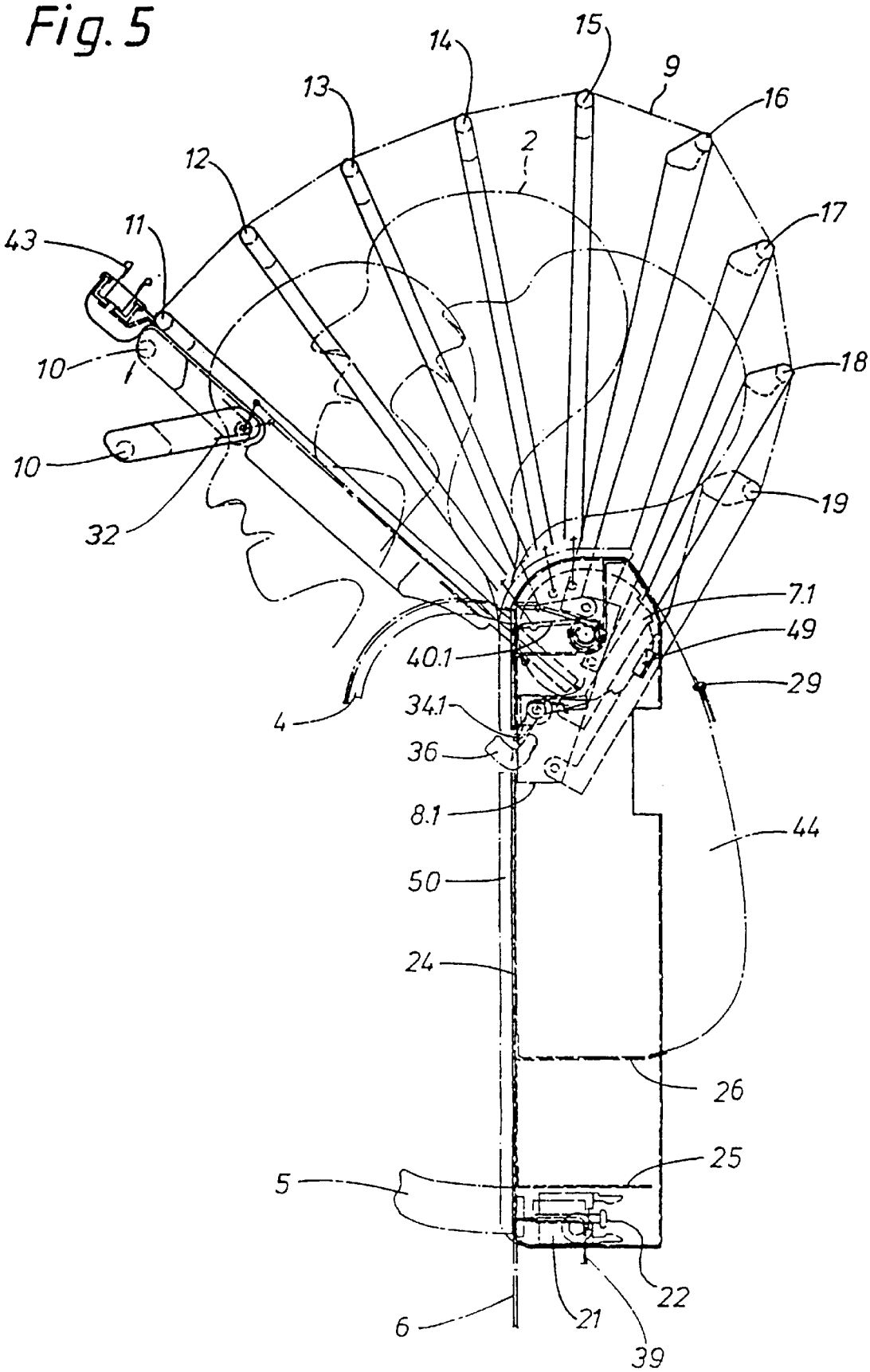
FIG. 5 is a side view in operation having the extended protection device, as well as the exposed face protection bar 10.

In its visibly shown resting position, the protection device is set approximately parallel to the back, whereby the p-bars are arranged set within a casing 3. From this set resting position, it can be titled up toward the front by an angle of approx. 220°, whereupon it has taken on a raised protective position which spans the head area, as shown in FIG. 5. For the swinging operation of the protection device between its set resting position and its raised protective position, two pre-loaded springs 40.1, 40.2 are located in the casing 3.

To release the protection device, there is a magnetic switch 21 in the lower area of the casing, which is controlled by a sensor 23 when the sportsman takes a hazardous fall. By pulling the movable locking pins 22 in the magnetic switch 21, the latching of the protection device is automatically released, whereupon the p-bar 11 is released and rapidly shoots to the top under spring loading. This sensory mechanism is also already known in roll bars in automobile construction. It responds to a change in the angle of inclination, as well as to the acceleration and deceleration.

As is recognized in connection with the representations in FIGS. 3, 4, 5, 6, 7 and 8, the casing comprises a deep-drawn, molded shell 24 which is fitted to the body and can be made of plastic. For weight optimization, the molded shell 24 can be cut out between the reinforcement piece 28 and closed with a backpack fabric.

Figure 4:
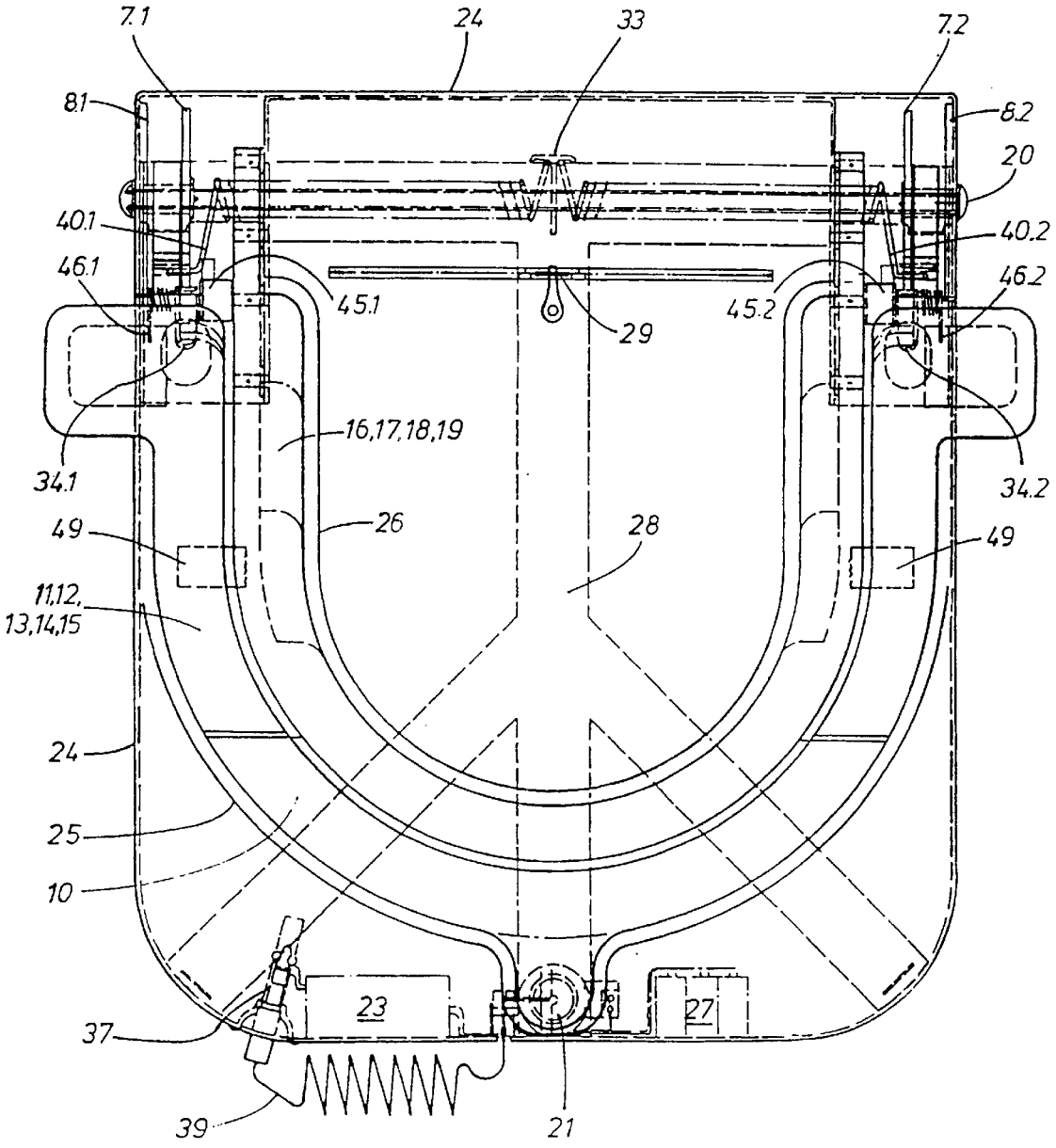
FIG. 4 is a view of the safety casing 3 showing the inserted, spring-loaded protection device with release and drive sections, as well as energy reserve 27.
Figure 6:
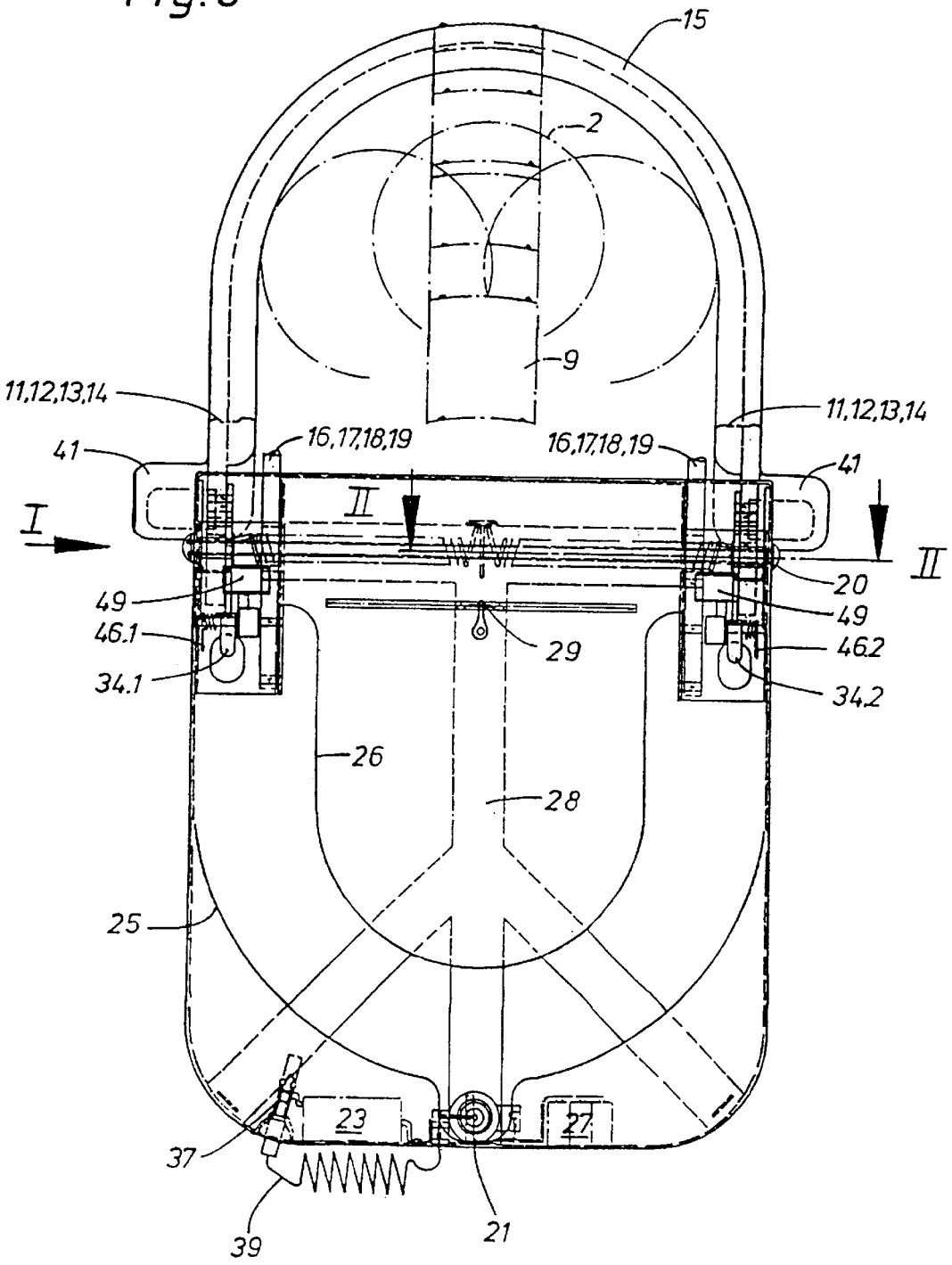
FIG. 6 is a view of the safety casing 3 with only one p-bar 15 shown, the p-bars 11, 12, 13, 14, 16, 17, 18, 19 are shown broken-off; the possible swing of the head is indicated, and above that is indicated the fabric band 9 which is connected to the p-bars 11–19.

In FIGS. 4 and 6, the reinforcement piece 28 for receiving the belts 4, 5, 6 and magnetic switch 21 can be seen, and a zipper 29 in the backpack covering, which functions as an access to the storage space 44, is indicated.

Figure 8:
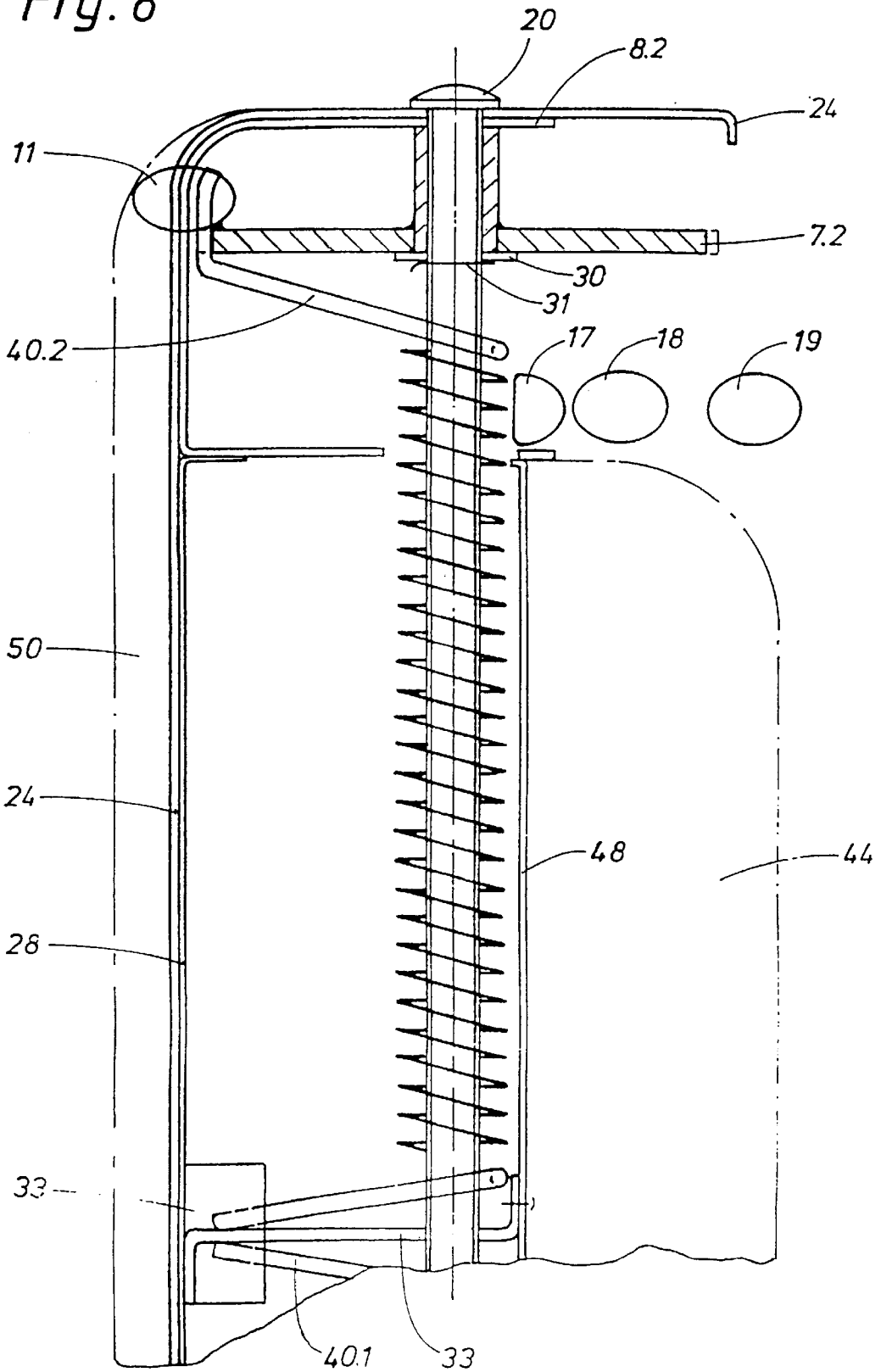
FIG. 8 is a side view in half section on a scale approx. 1:1 of a cross-section through the drive device with the spring 40.2, toothed disk 7.2, and storage space 44 according to the sectional line II—II in FIG. 6.

As is shown from the side in half section in FIG. 8 on a scale of 1:1, the reinforcement piece 28 is connected on the right and left with the reinforcement pieces 8.1 and 8.2, which function for seating the guide rod 20, passing through transversely at the top.

FIG. 8 shows the rotatably-mounted toothed disk 7.2 with the disk 30 and safety retainer 31. Also visible is the pre-loaded spring 40.2, which is attached to the guide rod 20 and which is supported in the center on the reinforcement piece 33 and hangs outside on the p-bar 11. The pre-loaded springs and the guide rod are separated from the storage space by a covering 48.

Since only the p-bar 11 is firmly connected to the toothed disks 7.1, 7.2, and the remaining bars are, for spatial reasons, both pivotably mounted and arranged offset, the remaining bars are connected to each other by a fabric band 9 pulled from the p-bar 11 out of the casing. As apparent in FIG. 5, a face protection bar 10 is, in addition, rotated in front of the face out of the p-bar 11, controlled by force of a stop. The spring 32 presses the face bar 10 onto the p-bar 11 until the forced control takes effect.

When the p-bar shoots to the top and the toothed disks 7.1, 7.2 rotate around the guide rod 20, the detent pawls 34.1, 34.2 swing out slightly against their spring loading, whereby the toothed disks 7.1, 7.2 are moved over the detent pawls 34.1, 34.2 in a ratcheting manner. When the direction of the p-bars is reversed (accident or loading) the teeth of the toothed disks 7.1, 7.2 act instantaneously as latches with the detent pawls 34.1, 34.2. The transmission of force occurs through the pins 47. The reinforcement pieces 45.1, 45.2 are connected at points with the reinforcement pieces 8.1, 8.2 and also function as seats for the pawls and pins.

Since the front p-bar 11 is locked via the toothed disks 7.1, 7.2, and the rear p-bars 16, 17, 18, 19 drive against a stop, the p-bars 12 -19 are held at set distances by a fabric band 9 prior to the return folding. The p-bar 19 is supported, e.g. by the extension arm 49 against the toothed disks 7.1, 7.2.

In order to prevent too hard a bumping of the p-bars 11, 16, 17, 18, 19 into their end positions, impact-absorbing buffer elements 35 can be arranged in the stop areas, which can comprise an elastomeric material, for example..

Figure 7:
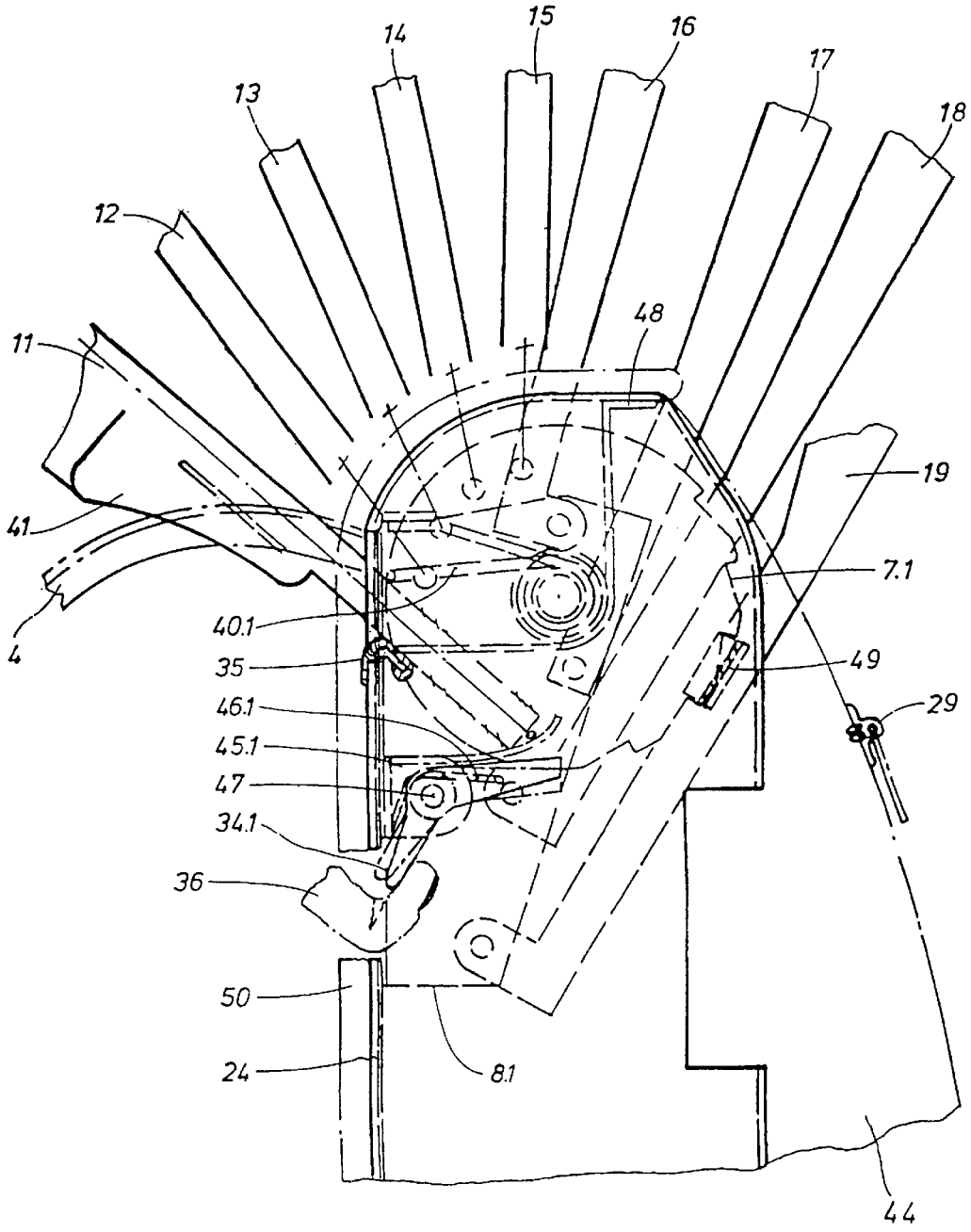
FIG. 7 is a section of the drive and holding sections according to the view I in FIG. 6.

For a possible erroneous release, the detent pawls 34.1, 34.3 can be lifted against their spring force through the two openings in the shell 24 and foam 50 at the right and left with the finger 36, after the casing is taken off, as is clearly shown in FIG. 7. Thus, the entire protection device can be pressed into the casing 3 until the magnetic switch 21 again comes to rest on the crown spring 43.

As an alternative to the contact position 37 on the casing, the contact position 38 can also be used on the saddle, whereby the release safety can be increased. At a certain displacement of the person from the saddle, the release cord 39, which is guided over a clamping adjustment disk 42, opens the magnetic switch 21 mechanically, and the protection device begins to function.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An automatic protection device for head and body of persons in which the protection device is adjustable into a protective position from a set resting position, comprising a protection helmet system, a casing for carrying the helmet system and adapted to be worn on the back or the chest of the person, the helmet system being equipped with a drive element integrated into the casing, the drive element serving to rotate the helmet system upwardly over the head of the person, the drive element comprising a support element having round, toothed disks (7.1, 7.2), the toothed disks being set into a rotating motion by force of a pre-loaded spring (40.1, 40.2), and the helmet system comprising protection bars (11–19) which are brought into the protective position by the rotating motion of the disks.

2. The protection device according to claim 1, wherein the pre-loaded spring comprises torsion springs (40.1, 40.2) and the drive element includes a latching mechanism which is impinged by the torsion springs such that their force quickly raises the protection helmet into the protective position upon lifting of the latching mechanism.

3. The protective device according to claim 2, wherein the latching mechanism comprises a magnetic switch 21.

4. The protection device according to claim 2, further comprising a toothed resting member which is moved by the toothed disks (7.1, 7.2), the teeth of the resting members acting together with interlocking opposing teeth of the toothed disks during the rotation into the protective position, the opposing teeth being held by detent pawls (34.1, 34.2) which are loaded by springs (46.1, 46.2).

5. The protection device according to claim 4, wherein the latching mechanism, the toothed disks (7.1, 7.2) and the pre-loaded springs (40.1, 40.2) are rotatably held by a guide rod (20).

6. The protection device according to claim 1, further comprising a storage space (44) in the casing which is separated from carrying space for the helmet system by a covering (48) and separation walls (25, 26).

7. The protection device according to claim 1, wherein one protection bar (11) is firmly connected to the toothed disks (7.1, 7.2), the one protection bar (11) having integrated into it a face protection bar (10) and a shoulder protector (41).

8. The protection device according to claim 7, wherein the protection bars (12–19) other than said one protection bar (11) comprise tubes which are rotatably mounted and held in their protective position spaced apart by a fabric band (9).

9. The protection device according to claim 1, wherein the entire protection device is integrated into the casing, and the casing is in a form of a backpack.

* * * * *